US011781378B2

(12) United States Patent
Caregnato et al.

(10) Patent No.: US 11,781,378 B2
(45) Date of Patent: Oct. 10, 2023

(54) SHADING DEVICE COMPRISING A MOTORISED DRIVE DEVICE

(71) Applicant: SOMFY ACTIVITES SA, Cluses (FR)

(72) Inventors: Stéphane Caregnato, Cluses (FR); Miguel Leleu, Cluses (FR); Clément Stephan, Cluses (FR); Eric Lagarde, Cluses (FR); Norbert Dupielet, Cluses (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 18/002,581

(22) PCT Filed: Jun. 29, 2021

(86) PCT No.: PCT/EP2021/067873
§ 371 (c)(1),
(2) Date: Dec. 20, 2022

(87) PCT Pub. No.: WO2022/002955
PCT Pub. Date: Jan. 6, 2022

(65) Prior Publication Data

US 2023/0193690 A1 Jun. 22, 2023

(30) Foreign Application Priority Data

Jun. 30, 2020 (FR) ..... 2006872

(51) Int. Cl.
*E06B 9/72* (2006.01)
*E06B 9/42* (2006.01)
(Continued)

(52) U.S. Cl.
CPC ..... *E06B 9/72* (2013.01); *E06B 9/42* (2013.01); *H01R 13/6205* (2013.01); *H01R 13/631* (2013.01)

(58) Field of Classification Search
CPC ..... E06B 9/72; E06B 9/42; H01R 13/6205; H01R 13/631
See application file for complete search history.

(56) References Cited

U.S. PATENT DOCUMENTS 10,221,620 B2 3/2019 Michel et al.
10,227,822 B2 3/2019 Lagarde et al.
(Continued)

FOREIGN PATENT DOCUMENTS

CN 204941310 U 1/2016
CN 107923219 A 4/2018
(Continued)

OTHER PUBLICATIONS

Search Report for French Application No. FR 2006872 dated Mar. 26, 2021.
(Continued)

*Primary Examiner* — Beth A Stephan
(74) *Attorney, Agent, or Firm* — Pearne & Gordon LLP

(57) ABSTRACT

A shading device comprises a power supply device comprising a battery, a first and a second electrical connection elements and a resilient element. The battery is disposed at a holding device for holding the screen. The first element is disposed at a load bar or the screen and configured so as to be electrically connected to an external electrical supply source. The second element is disposed at the holding device and configured to cooperate with the first element. The resilient element is configured to be fixed on the load bar or on the screen. The first element is integral with the resilient element. Furthermore, the resilient element is configured to compensate a misalignment of the first electrical connection element with respect to the second electrical connection element, when the screen reaches a position for recharging the battery.

10 Claims, 7 Drawing Sheets

(51) Int. Cl.
*H01R 13/62* (2006.01)
*H01R 13/631* (2006.01)

(56) References Cited

U.S. PATENT DOCUMENTS

| | | | | |
|---|---|---|---|---|
| 10,847,983 | B2 | 11/2020 | Nien et al. | |
| 11,223,218 | B2 | 1/2022 | Nien et al. | |
| 11,293,224 | B2 * | 4/2022 | Pereira | E06B 9/322 |
| 2007/0065138 | A1 | 3/2007 | Miller | |

FOREIGN PATENT DOCUMENTS

| | | | |
|---|---|---|---|
| CN | 108729836 | A | 11/2018 |
| DE | 202016105745 | U1 | 11/2016 |
| JP | 3186530 | U | 10/2013 |
| JP | 2019214871 | A | 12/2019 |
| NL | 1025450 | C2 | 8/2005 |
| WO | 2017036947 | A1 | 3/2017 |
| WO | 2017036966 | A1 | 3/2017 |

OTHER PUBLICATIONS

Search Report for International Application No. PCT/EP2021/067873 dated Sep. 15, 2021.

* cited by examiner

SHADING DEVICE COMPRISING A MOTORISED DRIVE DEVICE

CROSS-REFERENCE TO RELATED APPLICATIONS

This is a National Stage application of PCT international application PCT/EP2021/067873, filed on Jun. 29, 2021, which claims priority from French Patent Application No. 20 06872, filed on Jun. 30, 2020, both which are incorporated herein by reference in their entirety.

BACKGROUND OF THE INVENTION

Field of the Invention

The present invention relates to a shading device.

In general, the present invention relates to the field of shading devices comprising a motorised drive device that moves a screen, between at least a first position and at least a second position.

A motorised drive device comprises an electromechanical actuator of a movable closing, shading or sun protection element, such as a blind or any other equivalent material, hereafter referred to as a screen.

Description of the Related Art

WO 2017/036966 A1 describes a shading device comprising a screen, a holding device for holding the screen, a load bar, a motorised drive device and an electrical power supply device. A first end of the screen is disposed at the holding device of the screen. A second end of the screen is fixed on the load bar. The motorised drive device comprises an electromechanical actuator. The electromechanical actuator is configured to move the screen. The electrical power supply device comprises a battery, a first electrical connection element and a second electrical connection element. The battery is disposed at the holding device of the screen. The battery is electrically connected to the electromechanical actuator. The first electrical connection element is disposed at the load bar or the screen. The first electrical connection element is configured so as to be electrically connected to an external electrical energy supply source, so as to recharge the battery. Furthermore, the second electrical connection element is disposed at the holding device of the screen. The second electrical connection element is configured to cooperate with the first electrical connection element, only when the screen is in a position for recharging the battery. The position for recharging the battery corresponds either to an upper end-of-travel position of the screen, or to a position of the screen where the load bar is in proximity to the holding device of the screen, so as to establish an electrical connection between the first electrical connection element and the second electrical connection element. This shading device is generally satisfactory.

BRIEF SUMMARY OF THE INVENTION

However, the disadvantage of said shading device is that the electrical power supply device is not able to compensate a misalignment of the first electrical connection element with respect to the second electrical connection element, when the screen reaches the position for recharging the battery, either along a width of the shading device or along a depth of the shading device.

The present invention aims to overcome the aforementioned disadvantages and to provide a shading device for compensating a misalignment of a first electrical connection element with respect to a second electrical connection element, when the screen reaches a position for recharging the battery.

In this respect, the present invention is directed to a shading device, the shading device comprising at least:

a screen, a screen holding device for holding the screen, a first end of the screen being disposed at the holding device of the screen, a load bar, a second end of the screen being fixed on the load bar, a motorised drive device, and an electrical power supply device, the motorised drive device comprising at least:

an electromechanical actuator, the electromechanical actuator being configured to move the screen, the electrical power supply device comprising at least:

a battery, the battery being disposed at the holding device of the screen, the battery being electrically connected to the electromechanical actuator, a first electrical connection element, the first electrical connection element being disposed at the load bar or the screen, the first electrical connection element being configured so as to be electrically connected to an external electrical energy supply source, so as to recharge the battery, and a second electrical connection element, the second electrical connection element being disposed at the holding device of the screen, the second electrical connection element being configured to cooperate with the first electrical connection element, only when the screen is in a position for recharging the battery, the position for recharging the battery corresponding either to an upper end-of-travel position of the screen, or to a position of the screen where the load bar is in proximity to the holding device of the screen, so as to establish an electrical connection between the first electrical connection element and the second electrical connection element.

According to the invention, the electrical power supply device further comprises a resilient element, the resilient element being configured to be fixed on the load bar or on the screen, the first electrical connection element being integral with the resilient element. Furthermore, the resilient element is configured to compensate a misalignment of the first electrical connection element with respect to the second electrical connection element, when the screen reaches the position for recharging the battery.

Thus, when the screen reaches the position for recharging the battery, the resilient element allows the first electrical connection element to be aligned with the second electrical connection element, in particular along a width of the shading device or along a depth of the shading device or along the width of the shading device and the depth of the shading device.

In this way, the design of the electrical power supply device in such a way allows the first electrical connection element to reach the second electrical connection element disposed at the holding device of the screen, following a movement of the screen to the position for recharging the battery, while compensating a misalignment of the first electrical connection element with respect to the second electrical connection element via the resilient element, in particular due to the position of the screen with respect to the holding device of the screen, depending on the width of the shading device and/or depending on the depth of the shading device.

Therefore, the design of the electrical power supply device in such a way makes recharging the battery from the external electrical energy supply source in a simple and convenient manner for the user.

Furthermore, the design of the electrical power supply device in such a way avoids the need for a user to climb a step ladder to access the second electrical connection element disposed at the holding device of the screen.

Moreover, the design of the electrical power supply device in such a way improves the aesthetics of the shading device, since the second electrical connection element can be integrated at the holding device of the screen and daylight can be minimised between the screen and the holding device of the screen.

The resilient element thus allows the first electrical connection element to connect to the second electrical connection element, when the screen reaches the position for recharging the battery, in other words before the load bar reaches the holding device of the screen, during an upward movement of the screen.

Furthermore, the resilient element is configured to deform when the first electrical connection element is brought into contact with the second electrical connection element, when the screen reaches the position for recharging the battery.

Moreover, the resilient element is configured to deform in the event of a collision between the first electrical connection element and a part of the shading device, in particular the holding device of the screen, during a movement of the screen towards the position for recharging the battery, so as to avoid damage to the shading device, in particular in the event that the electromechanical actuator moves the screen beyond the position for recharging the battery, during an upward movement of the screen.

The resilient element is also configured to deform when storing and transporting the shading device and, more particularly, the electrical power supply device.

Furthermore, assembling the resilient element supporting the first electrical connection element on the load bar or on the screen, in particular on a lower portion of the screen, facilitates an electrical connection between the external electrical energy supply source and the first electrical connection element, since this electrical connection can be established when the screen is in a lowered position or in a lower end-of-travel position, in other words without having to climb a step ladder to access the first electrical connection element.

According to an advantageous feature of the invention, the resilient element comprises at least one portion that forms a spring.

According to another advantageous feature of the invention, the first electrical connection element comprises a first magnetic portion. The second electrical connection element comprises a second magnetic portion. Furthermore, the first magnetic portion cooperates with the second magnetic portion, so as to hold the first electrical connection element against the second electrical connection element, when the screen is in the position for recharging the battery.

According to another advantageous feature of the invention, the first electrical connection element comprises a first centring element. The second electrical connection element comprises a second centring element. Furthermore, the first centring element cooperates with the second centring element, so as to centre the first electrical connection element with respect to the second electrical connection element, when the screen is in the position for recharging the battery.

According to another advantageous feature of the invention, the first centring element is a pin. Furthermore, the second centring element is a hole, or vice versa.

According to another advantageous feature of the invention, the electrical power supply device comprises at least one fastening element. Furthermore, the fastening element fastens the resilient element to the load bar or to the screen.

According to another advantageous feature of the invention, the fastening element is a resilient snap-in fastening element. Furthermore, the fastening element is configured to cooperate with an outer contour of the load bar.

According to another advantageous feature of the invention, the fastening element is a clamp. Furthermore, the fastening element is configured to be clamped onto the screen.

According to another advantageous feature of the invention, the electrical power supply device comprises a third electrical connection element. The third electrical connection element is integral with the resilient element. Furthermore, the third electrical connection element is configured so as to be electrically connected, on the one hand, to the first electrical connection element and, on the other hand, to the external electrical energy supply source.

According to another advantageous feature of the invention, the shading device further comprises a winding tube. The screen is can be rolled onto the winding tube. Furthermore, the winding tube is arranged so as to be rotated by the electromechanical actuator.

BRIEF DESCRIPTION OF THE DRAWINGS

Further features and advantages of the invention will become apparent from the following description, made with reference to the attached drawings, which are given as non-limiting examples.

DETAILED DESCRIPTION

Figure 1:
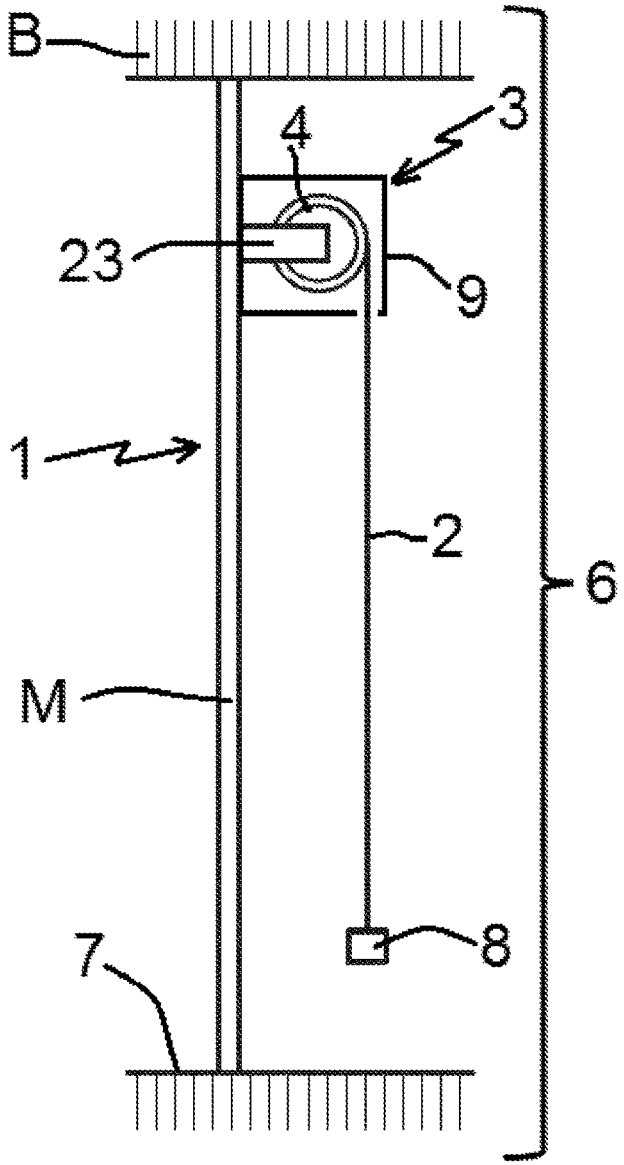
FIG. 1 is a schematic cross-sectional view of an installation comprising a shading device according to a first embodiment of the invention.
Figure 2:
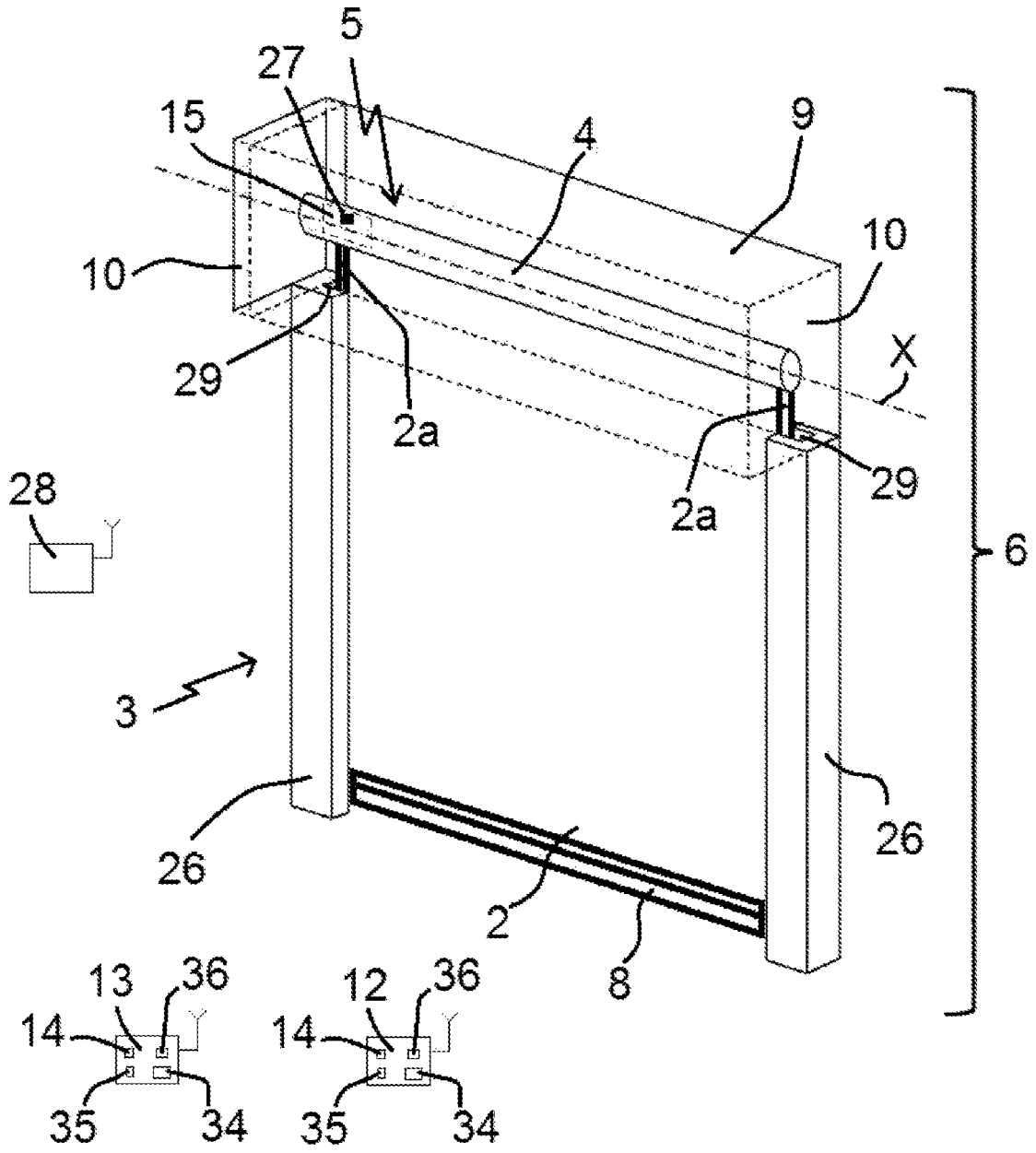
FIG. 2 is a schematic perspective view of the installation shown in FIG. 1.

Firstly, with reference to FIGS. 1 and 2, an installation 6 is described that comprises a closing, shading or sun protection device 3 according to a first embodiment of the invention, installed in a building B comprising an opening 1, window or door. This installation 6 is equipped with a screen 2 forming part of the closing, shading or sun protection device 3, in particular a motorised blind.

The closing, shading or sun protection device 3 is hereinafter referred to as the "shading device". The shading device 3 comprises the screen 2.

The shading device 3 may comprise a blind, in particular a fabric, a roller blind, a pleated blind or a blind with slats. The present invention applies to all types of shading device.

With reference to FIGS. 1 to 4, a roller blind according to the first embodiment of the invention is described.

The shading device 3 comprises a winding tube 4 and a motorised drive device 5. The motorised drive device 5 comprises an electromechanical actuator 11, shown in FIG. 3.

The screen 2 of the shading device 3 is rolled onto the winding tube 4 driven by the motorised drive device 5. Thus, the screen 2 can be moved between a rolled-up position, in particular an upper position, and an unrolled position, in particular a lower position.

The screen 2 of the shading device 3 is a closing, shading and/or sun protection screen, which can be wound and unwound around the winding tube 4, the inner diameter of which is greater than the outer diameter of the electromechanical actuator 11, such that the electromechanical actuator 11 can be inserted into the winding tube 4, when the shading device 3 is assembled.

Advantageously, the shading device 3 comprises a holding device 9, 23.

Advantageously, the holding device 9, 23 may comprise two supports 23. One support 23 is disposed at each end of the winding tube 4, in an assembled configuration of the shading device 3.

Thus, the winding tube 4 is held by the supports 23. Only one of the supports 23 is visible in FIGS. 1 and 5. The supports 23 allow the shading device 3 to be mechanically connected to the structure of the building B, in particular to the wall M of the building B.

Advantageously, the holding device 9, 23 may comprise a housing 9. Furthermore, the winding tube 4 and at least part of the screen 2 are housed inside the housing 9, in the assembled configuration of the shading device 3.

In general, the housing 9 is disposed above the opening 1, or at the top of the opening 1.

Figure 5:
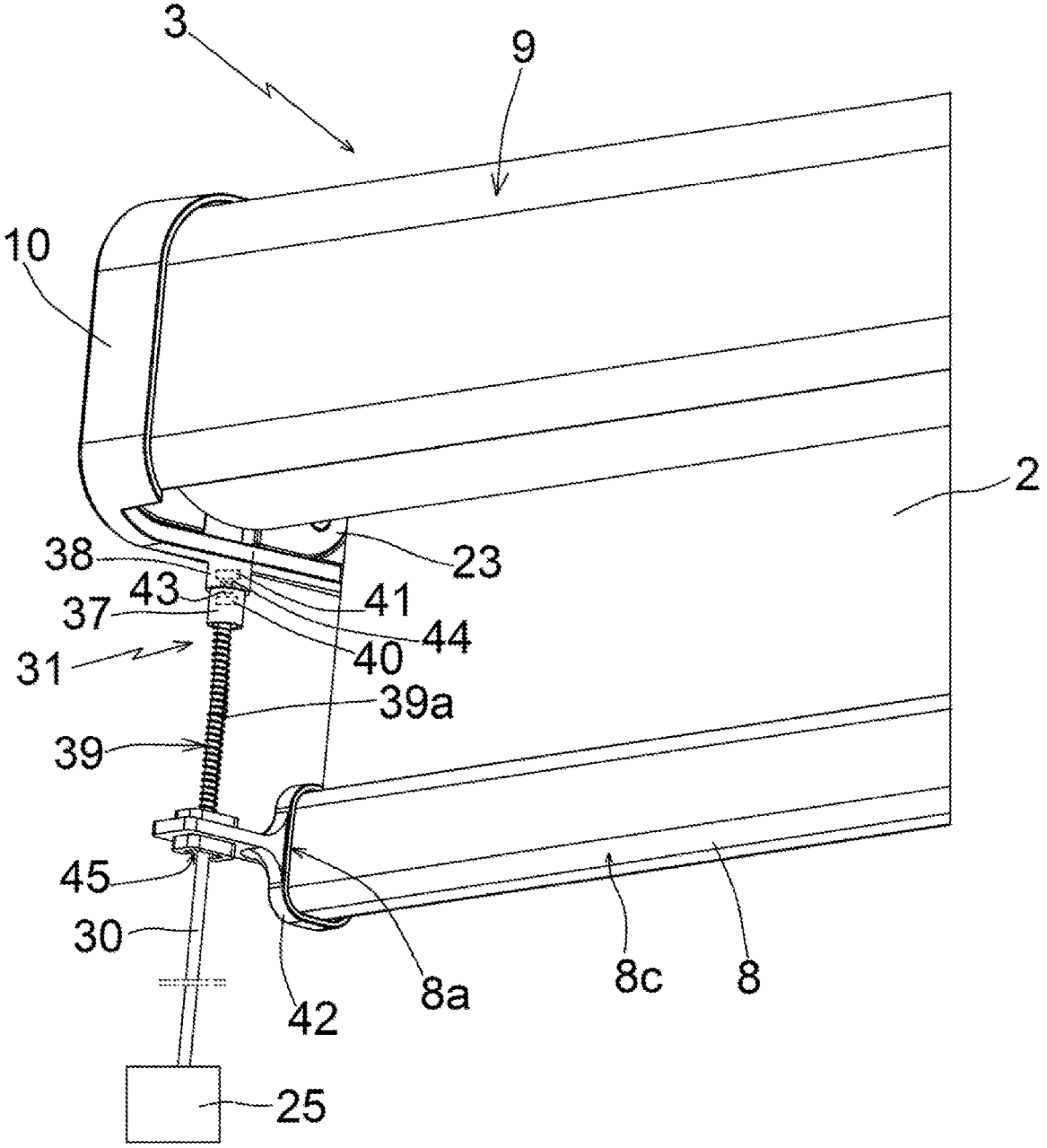
FIG. 5 is a larger scale and partial schematic view of the shading device shown in FIG. 4, from a different angle of view.

Here and as shown in FIGS. 1 and 5, the supports 23 are also housed inside the housing 9.

Figure 4:
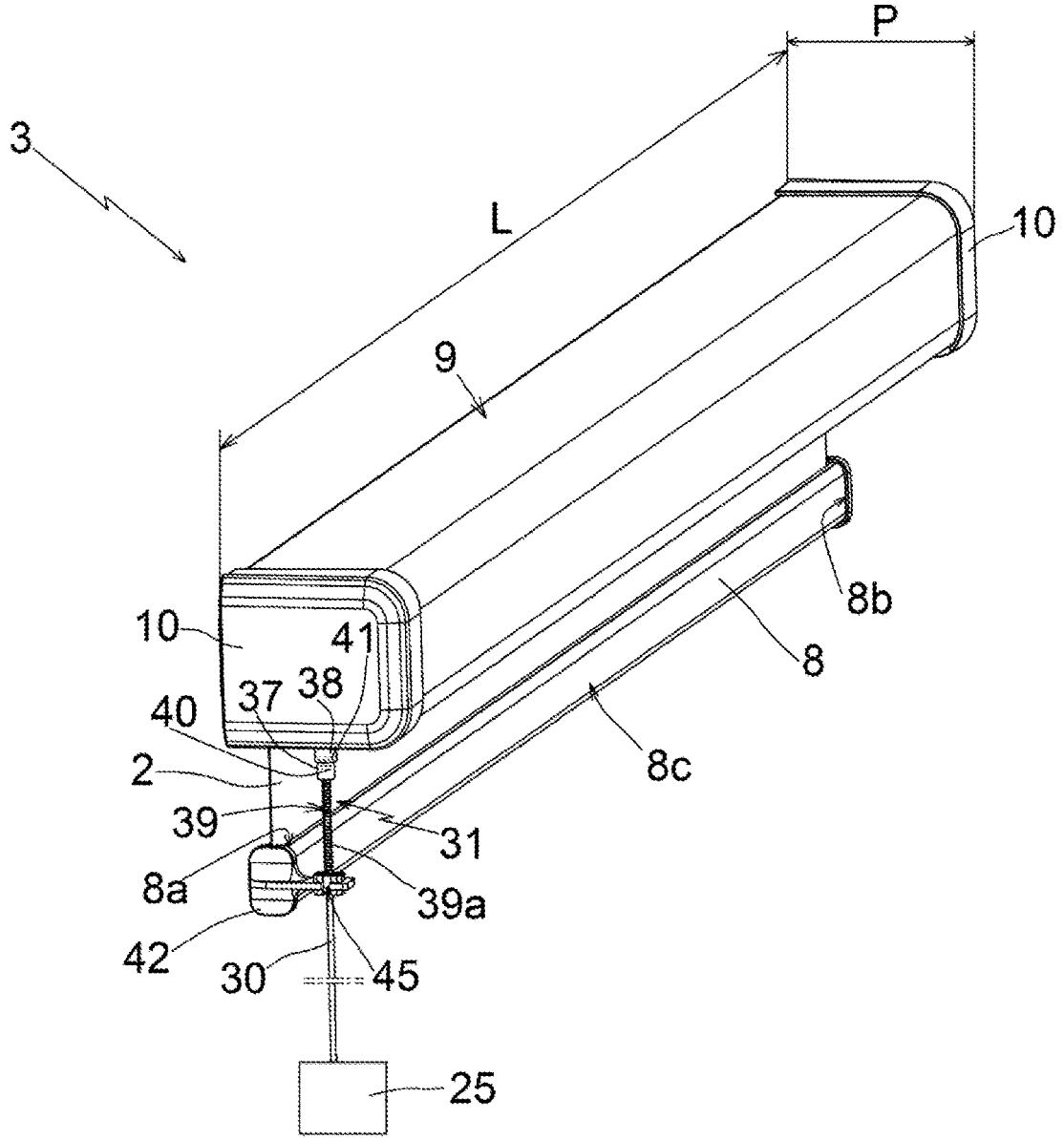
FIG. 4 is a schematic perspective view of a shading device of the installation shown in FIGS. 1 and 2.

Advantageously, the housing 9 comprises two side panels 10, as illustrated in FIGS. 2, 4 and 5. One side panel 10 is disposed at each end of the housing 9, in the assembled configuration of the shading device 3.

In variant, as shown in FIG. 2, the winding tube 4 is held via the housing 9, in particular via the side panels 10 of the housing 9, without using supports, such as the supports 23 mentioned above.

Advantageously, the shading device 3 may also comprise two lateral guide rails 26, as illustrated in FIG. 2 only. Each lateral guide rail 26 comprises a groove 29. Each groove 29 of one of the lateral guide rails 26 cooperates, in other words is configured to cooperate, with a lateral edge 2*a* of the screen 2, in the assembled configuration of the shading device 3, so as to guide the screen 2, when the screen 2 is wound onto and unwound of the winding tube 4.

The electromechanical actuator 11 is, for example, tubular. This allows the winding tube 4 to be rotated about an axis of rotation X, so as to unwind or wind up the screen 2 of the shading device 3.

Thus, the screen 2 may be wound and unwound on the winding tube 4. When mounted, the electromechanical actuator 11 is inserted into the winding tube 4.

The shading device 3 further comprises a load bar 8 for exerting tension on the screen 2.

The roller blind, which forms the shading device 3, comprises a fabric, which forms the screen 2 of the roller blind 3. A first end of the screen 2, in particular the upper end of the screen 2, in the assembled configuration of the shading device 3, is fixed on the winding tube 4. Furthermore, a second end of the screen 2, in particular the lower end of the screen 2, in the assembled configuration of the shading device 3, is fixed on the load bar 8.

Here, the fabric forming the screen 2 is made of a textile material.

In one embodiment, not shown, the first end of the screen 2 has a hem through which a rod, in particular made of plastic, is disposed. Said hem at the first end of the screen 2 is obtained by sewing the fabric that forms the screen 2. When the screen 2 is assembled on the winding tube 4, the hem and the rod at the first end of the screen 2 are slid into a groove on the outer face of the winding tube 4, in particular over the entire length of the winding tube 4, such that the screen 2 is connected to the winding tube 4 and such that the screen 2 can be wound onto and unwound of the winding tube 4.

Regardless of the embodiment, the first end of the screen 2 is disposed at the holding device 9, 23, in that said first end remains above the opening 1 when the shading device 3 is assembled.

In the case of a roller blind, the upper rolled-up position corresponds to a predetermined upper end-of-travel position, or to the load bar 8 of the screen 2 bearing against an edge of a housing 9 of the roller blind 3, and the lower unrolled position corresponds to a predetermined lower end-of-travel position, or to the load bar 8 of the screen 2 bearing against a threshold 7 of the opening 1, or to the screen 2 being unrolled completely.

Advantageously, the motorised drive device 5 is controlled by a control unit. The control unit may be, for example, a local control unit 12 or a central control unit 13.

Advantageously, the local control unit 12 can be connected to the central control unit 13, via a wire or wireless connection.

Advantageously, the central control unit 13 can control the local control unit 12, and other similar local control units distributed throughout the building.

The motorised drive device 5 is, preferably, configured to execute the commands for unrolling or rolling up the screen 2 of the shading device 3, which can be issued, especially, by the local control unit 12 or the central control unit 13.

The installation 6 comprises either the local control unit 12, the central control unit 13, or the local control unit 12 and the central control unit 13.

Figure 3:
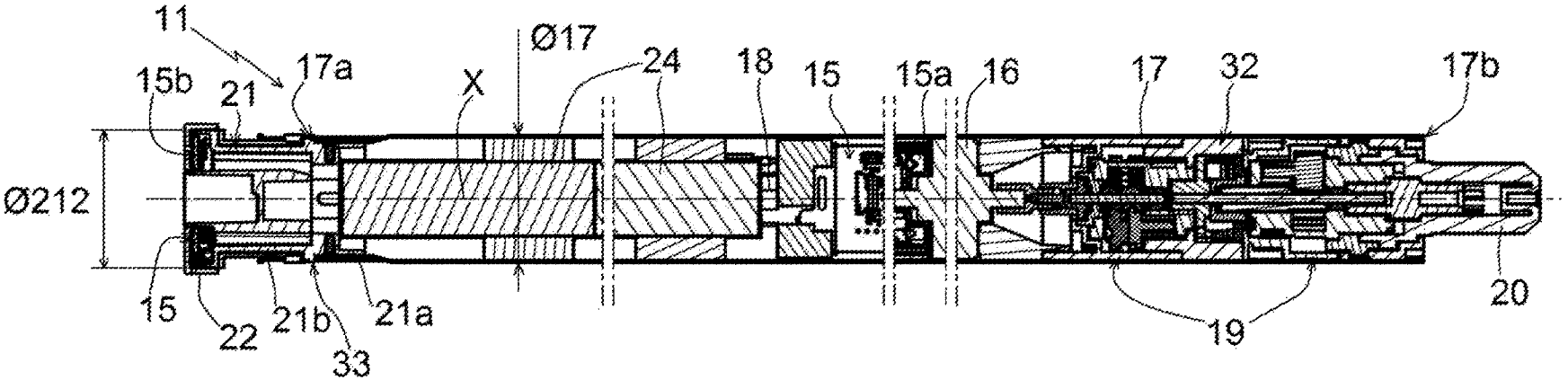
FIG. 3 is a schematic cross-sectional view of an electromechanical actuator of the installation shown in FIGS. 1 and 2, along a sectional plane passing through an axis of rotation of an output shaft of the electromechanical actuator.

The electromechanical actuator 11 belonging to the installation 6 of FIGS. 1 and 2 is now described in more detail, with reference to FIG. 3.

The electromechanical actuator 11 comprises an electric motor 16. The electric motor 16 comprises a rotor and a stator, not shown, positioned coaxially about the axis of rotation X of the winding tube 4 when the motorised drive device 5 is mounted.

Means for controlling the electromechanical actuator 11, which allow the screen 2 of the shading device 3 to move, comprise at least an electronic control unit 15. Said electronic control unit 15 is capable of operating the electric motor 16 of the electromechanical actuator 11, and, in particular, allowing the supply of electrical energy to the electric motor 16.

Thus, the electronic control unit 15 controls, especially, the electric motor 16, so as to open or close the screen 2, as described above.

The means of controlling the electromechanical actuator 11 comprise hardware and/or software means.

By way of a non-limiting example, the hardware means may comprise at least one microcontroller, not shown.

Advantageously, the electronic control unit 15 further comprises a first communication module 27, as illustrated in FIG. 2, which shows only that portion of the electromechanical actuator 11, in particular for receiving command orders, the command orders being emitted by a command orders transmitter, such as the local control unit 12 or the central control unit 13, said orders being intended to control the motorised drive device 5.

Advantageously, the first communication module 27 of the electronic control unit 15 is wireless. In particular, the first communication module 27 is configured to receive radio command orders.

Advantageously, the first communication module 27 may also allow receiving command orders transmitted by wired means.

Advantageously, the electronic control unit 15, the local control unit 12 and/or the central control unit 13 may be in communication with a weather station located inside the building B or remotely outside the building B, including, especially, one or more sensors that may be configured to determine, for example, temperature, luminosity or wind speed, in the case where the weather station is located outside the building B.

Advantageously, the electronic control unit 15, the local control unit 12 and/or the central control unit 13 may also be in communication with a server 28, as illustrated in FIG. 2, so as to control the electromechanical actuator 11 according to data made available remotely via a communication network, in particular an internet network that may be connected to the server 28.

The electronic control unit 15 can be controlled from the local control unit 12 and/or central control unit 13. The local control unit 12 and/or central control unit 13 is provided with a control keyboard. The control keyboard of the local control unit 12 or central control unit 13 comprises one or more selection elements 14 and, eventually, one or more display elements 34.

By way of non-limiting examples, the selection elements may comprise push buttons and/or touch-sensitive keys. The display elements may comprise light emitting diodes and/or an LCD (Liquid Crystal Display) or TFT (Thin Film Transistor) display. The selection and display elements can also be implemented in the form of a touch screen.

The local control unit 12 and/or central control unit 13 comprises at least a second communication module 36.

Thus, the second communication module 36 of the local control unit 12 or central control unit 13 is configured to transmit, in other words transmits, command orders, in particular by wireless means, for example radio, or by wired means.

Furthermore, the second communication module 36 of the local control unit 12 or central control unit 13 may also be configured to receive, in other words receives, command orders, in particular via the same means.

The second communication module 36 of the local control unit 12 or central control unit 13 is configured to communicate, in other words communicates, with the first communication module 27 of the electronic control unit 15.

Thus, the second communication module 36 of the local control unit 12 or central control unit 13 exchanges command orders with the first communication module 27 of the electronic control unit 15, either monodirectionally or bidirectionally.

Advantageously, the local control unit 12 is a control point, which may be fixed or mobile. A fixed control point may be a control box intended to be fixed on a façade of the wall M of the building B or on a face of a window frame or door frame. A mobile control point can be a remote control, a smartphone or a tablet.

Advantageously, the local control unit 12 and/or central control unit 13 further comprises a controller 35.

The motorised drive device 5, in particular the electronic control unit 15, is, preferably, configured to execute command orders to move, especially close as well as open, the screen 2 of the shading device 3. Said command orders may be emitted, especially, by the local control unit 12 or by the central control unit 13.

The motorised drive device 5 can be controlled by the user, for example by receiving a command order corresponding to pressing the or one of the selection elements 14 of the local control unit 12 or central control unit 13.

The motorised drive device 5 may also be controlled automatically, for example by receiving a command order corresponding to at least one signal from at least one sensor and/or a signal from a clock of the electronic control unit 15, in particular of the microcontroller. The sensor and/or the clock may be integrated in the local control unit 12 or in the central control unit 13.

Advantageously, the electromechanical actuator 11 comprises a casing 17, in particular a tubular casing. The electric motor 16 is mounted inside the casing 17, in particular in an assembled configuration of the electromechanical actuator 11.

Here, the casing 17 of the electromechanical actuator 11 is cylindrical, in particular rotationally symmetrical about the axis of rotation X.

In one embodiment, the casing 17 is made of metal.

The material of the casing of the electromechanical actuator is not limiting and may be different. In particular, it can be a plastic material.

The shading device 3 further comprises an electrical power supply device 31. The electromechanical actuator 11 is electrically connected to the electrical power supply device 31.

The electrical power supply device 31 comprises at least one battery 24. The electromechanical actuator 11 is supplied with electrical energy, in other words is configured to be supplied with electrical energy, by means of the battery 24.

Advantageously, the electromechanical actuator 11 comprises the battery 24.

Thus, and as seen in FIG. 3, the battery 24 is disposed inside the casing 17, in particular in the assembled configuration of the electromechanical actuator 11.

In variant, not shown, the battery 24 can be disposed at the housing 9 of the shading device 3. The battery 24 can thus be disposed inside or outside the housing 9. The battery 24 can also be disposed inside the winding tube 4, while being outside the casing 17.

Regardless of the embodiment, the battery 24 is disposed at the holding device 9, 23, as per the first end of the screen 2.

Here, the electromechanical actuator 11 comprises a power supply cable 18 that allows it to be supplied with electrical energy, especially of the electronic control unit 15 and the electric motor 16, in particular from the battery 24.

Here and as shown in FIG. 3, the battery 24 is electrically connected directly to the electronic control unit 15, via the power supply cable 18.

The battery 24 is rechargeable.

Advantageously, the battery 24 comprises one or more energy storage elements. The energy storage elements of the battery 24 may be, especially, rechargeable accumulators or rechargeable cells.

Advantageously, the motorised drive device 5 and, in particular, the electronic control unit 15, comprises charging elements configured to charge the battery 24 from electrical energy supplied by an external electrical energy supply source 25, as illustrated in FIGS. 4 and 5.

Advantageously, the external electrical energy supply source 25 is a charger that can be plugged into a wall socket, so as to recharge the battery 24 from a mains power supply.

Advantageously, the electronic control unit 15 comprises a first electronic board 15*a* and a second electronic board 15*b*.

Advantageously, the first electronic board 15*a* is configured to control the electric motor 16. Furthermore, the second electronic board 15*b* is configured to, especially, allow the battery 24 to be recharged and, eventually, to access the parameter settings and/or configuration functions of the electromechanical actuator 11, by means of selection elements and, eventually, display elements, not shown.

Here and in a non-limitative way, the charging elements are disposed at the second electronic board 15*b*.

Advantageously, the electromechanical actuator 11 further comprises a gearbox 19 and an output shaft 20.

Advantageously, the gearbox 19 comprises at least one reduction stage. The reduction stage may be an epicyclic gear train.

The type and number of reduction stages of the gearbox are not limiting.

Advantageously, the electromechanical actuator 11 further comprises a brake 32.

By way of non-limiting examples, the brake 32 may be a spring brake, a cam brake, a magnetic brake or an electromagnetic brake.

Advantageously, the gearbox 19 and, eventually, the brake 32 are disposed inside the casing 17 of the electromechanical actuator 11, in the assembled configuration of the electromechanical actuator 11.

Advantageously, the electromechanical actuator 11 may also comprise an end-of-travel and/or obstacle detection device, which may be mechanical or electronic.

The winding tube 4 is rotated about the axis of rotation X and the casing 17 of the electromechanical actuator 11 while being supported via two pivot connections. The first pivot connection is formed at a first end of the winding tube 4 by means of a ring, not shown, inserted around a first end 17*a* of the casing 17 of the electromechanical actuator 11. The ring thus makes it possible to create a bearing. The second pivot connection, not shown, is formed at a second end of the winding tube 4.

Advantageously, the electromechanical actuator 11 further comprises a torque support 21, which may also be referred to as an "actuator head". The torque support 21 is disposed at the first end 17*a* of the casing 17 of the electromechanical actuator 11, in the assembled configuration of the electromechanical actuator 11.

The torque support 21 makes it possible to take up the forces exerted by the electromechanical actuator 11 and, especially, to ensure that the forces exerted by the electromechanical actuator 11, in particular the torque exerted by the electromechanical actuator 11, are taken up by the structure of the building B. Advantageously, the torque support 21 further allows forces exerted by the winding tube 4, especially the weight of the winding tube 4, the electromechanical actuator 11 and the screen 2, to be taken up, and ensures that these forces are taken up by the structure of the building B.

Thus, the torque support 21 of the electromechanical actuator 11 allows the electromechanical actuator 11 to be fixed on the holding device 9, 23, in particular on one of the supports 23 or on one of the side panels 10 of the housing 9.

Advantageously, the torque support 21 protrudes at the first end 17*a* of the casing 17 of the electromechanical actuator 11, in particular the end 17*a* of the casing 17 receiving the ring. The ring constitutes, in other words is configured to constitute, a rotational guide bearing for the winding tube 4, in the assembled configuration of the shading device 3.

Advantageously, the torque support 21 of the electromechanical actuator 11 may also allow the first end 17*a* of the casing 17 to be sealed.

Moreover, the torque support 21 of the electromechanical actuator 11 can support at least part of the electronic control unit 15.

Advantageously, the torque support 21 comprises a first portion 21*a* and a second portion 21*b*.

Advantageously, the first portion 21*a* of the torque support 21 is configured to cooperate, in other words cooperates, with the casing 17 of the electromechanical actuator 11, in particular in the assembled configuration of the electromechanical actuator 11. Furthermore, the second portion 21*b* of the torque support 21 is configured to cooperate, in other words cooperates, with the holding device 9, 23, in particular in an assembled configuration of the electromechanical actuator 11 in the shading device 3.

Thus, designing the torque support 21 so as to comprise the first and second portions 21*a*, 21*b* in one piece improves the rigidity of the torque support 21.

Advantageously, at least a part of the first portion 21*a* of the torque support 21 is generally cylindrical and is disposed within the casing 17 of the electromechanical actuator 11, in the assembled configuration of the electromechanical actuator 11.

Advantageously, an outer diameter Ø212 of at least a part of the second portion 21*b* of the torque support 21 is greater than an outer diameter Ø17 of the casing 17 of the electromechanical actuator 11.

Advantageously, the torque support 21 comprises a stop 33 configured to cooperate, in other words cooperates, with the casing 17, at the first end 17*a* of the casing 17, in the assembled configuration of the electromechanical actuator 11.

Thus, the stop 33 of the torque support 21 limits the depression of the first portion 21*a* of the torque support 21 into the casing 17, along the direction of the rotation axis X.

Furthermore, the stop 33 of the torque support 21 delimits the first and second portions 21*a*, 21*b* of the torque support 21 from one another.

Thus, only the first portion 21*a* of the torque support 21 is disposed within the casing 17 of the electromechanical actuator 11, once the torque support 21 has been fitted within the casing 17, up to the stop 33, in the assembled configuration of the electromechanical actuator 11.

Here, the stop 33 of the torque support 21 is designed as a shoulder and, more particularly, as a flange, in particular of cylindrical shape and with a straight generatrix.

Advantageously, the electronic control unit 15 can be supplied with electrical energy by means of the power supply cable 18.

Advantageously, the electronic control unit 15 can be disposed at least partly inside the casing 17 of the electromechanical actuator 11.

Moreover, the electronic control unit 15 can be disposed at least partly outside the casing 17 of the electromechanical actuator 11 and, in particular, mounted on one of the two supports 23, on one of the side panels 10 of the housing 9 or in the torque support 21.

Here, the first electronic board 15*a* of the electronic control unit 15 is disposed inside the casing 17 of the electromechanical actuator 11. Furthermore, the second electronic board 15*b* is disposed inside the torque support 21 of the electromechanical actuator 11.

Here and as illustrated in FIG. 3, the torque support 21 comprises a cover 22.

Furthermore, the second electronic board 15*b* is disposed within a housing formed between the second portion 21*b* of the torque support 21 and the cover 22.

Advantageously, the torque support 21 comprises at least one button, not shown.

Said button or buttons may allow the electromechanical actuator 11 to be set through one or more configuration modes, one or more control units 12, 13 to be paired with the electromechanical actuator 11, one or more parameters to be reset, which may be, for example, an end-of-travel position, the paired control unit(s) 12, 13 to be reset, or the movement of the screen 2 to be controlled.

Here, the torque support 21 comprises a single button.

The number of buttons on the torque support is not limiting and may be different. Especially, it may be greater than or equal to two.

Advantageously, the torque support 21 comprises at least one display device, not shown, so as to allow a visual indication, which may be, for example, a charging status of the battery 24.

Advantageously, the display device comprises at least one illumination source, not shown, in particular a light-emitting diode, mounted on the second electronic board 15*b* and, eventually, a transparent or translucent cover and/or a light guide, to allow the passage of the light emitted by the illumination source.

Here, the torque support 21 comprises a single display device.

The number of display devices is not limiting and may be different. Especially, it may be two or more.

Advantageously, the output shaft 20 of the electromechanical actuator 11 is disposed inside the winding tube 4 and at least partly outside the casing 17 of the electromechanical actuator 11.

Here, one end of the output shaft 20 protrudes from the casing 17 of the electromechanical actuator 11, in particular from a second end 17*b* of the casing 17 opposite the first end 17*a*.

Advantageously, the output shaft 20 of the electromechanical actuator 11 is configured to rotate a connecting element, not shown, connected to the winding tube 4. The connecting element is in the form of a wheel.

When the electromechanical actuator 11 is switched on, the electric motor 16 and the gearbox 19 rotate the output shaft 20. Furthermore, the output shaft 20 of the electromechanical actuator 11 rotates the winding tube 4 via the connecting element.

Thus, the winding tube 4 rotates the screen 2 of the shading device 3, so as to open or close the opening 1.

The electrical power supply device 31 is now described, with reference to FIGS. 4 and 5.

The electrical power supply device 31 further comprises a first electrical connection element 37 and a second electrical connection element 38.

The first electrical connection element 37 is disposed at the load bar 8 of the shading device 3. "At the load bar" will be understood to mean that the first electrical connection element 37 is integral with the load bar 8.

The first electrical connection element 37 is configured to be electrically connected, in other words is electrically connected, to the external electrical energy supply source 25, so as to recharge the battery 24.

The second electrical connection element 38 is disposed at the holding device 9, 23 of the screen 2. "At the holding device" will be understood to mean that the second electrical connection element 38 is integral with the holding device 9, 23, in particular to the housing 9, to one of the side panels 10 or to one of the supports 23, or to the torque support 21.

The second electrical connection element 38 is configured to cooperate, in other words cooperates, with the first electrical connection element 37 only when the screen 2 is in a position for recharging the battery 24, so as to establish an electrical connection between the first electrical connection element 37 and the second electrical connection element 38, therefore between the external electrical energy supply source 25 and the battery 24.

The position for recharging the battery 24 corresponds either to the upper end-of-travel position of the screen 2, or to a position of the screen 2 where the load bar 8 is in proximity to the holding device 9, 23 of the screen 2.

Especially, the load bar 8 can be considered to be in proximity to the holding device 9, 23 when the load bar 8 is located above the opening 1.

Thus, the electrical connection between the first electrical connection element 37 and the second electrical connection element 38 is only established when the first electrical connection element 37 is disposed against the second electrical connection element 38, such that the battery 24 can be charged from the external electrical energy supply source 25.

In this way, the electrical connection between the first electrical connection element 37 and the second electrical connection element 38 is established without a power supply cable connecting the first electrical connection element 37 to the second electrical connection element 38, so as to ensure the reliability of said electrical connection and to minimise the costs of producing the shading device 3.

The electrical power supply device 31 further comprises a resilient element 39. The resilient element 39 is configured to be fixed on the load bar 8. The first electrical connection element 37 is integral with the resilient element 39.

Furthermore, the resilient element 39 is configured to compensate, in other words compensates, a misalignment of the first electrical connection element 37 with respect to the second electrical connection element 38, when the screen 2 reaches the position for recharging the battery 24.

Thus, when the screen 2 reaches the position for recharging the battery 24, the resilient element 39 makes it possible to align the first electrical connection element 37 with respect to the second electrical connection element 38, in other words to implement an alignment of the first electrical connection element 37 with respect to the second electrical connection element 38, in particular along a width L of the shading device 3, or along a depth P of the shading device 3, or along the width L of the shading device 3 and the depth P of the shading device 3.

The width L is measured, when the shading device 3 is assembled, parallel to the axis of rotation X and the depth P is measured, when the shading device 3 is assembled, perpendicular to the width L and the direction of movement of the load bar 8.

The design of the electrical power supply device 31 allows the first electrical connection element 37 to reach the second electrical connection element 38 disposed at the holding device 9, 23 of the screen 2, following a movement of the screen 2 to the position for recharging the battery 24, while compensating a misalignment of the first electrical connection element 37 with respect to the second electrical connection element 38 by means of the resilient element 39, due especially to the position of the screen 2 with respect to the holding device 9, 23 of the screen 2, along the width L of the shading device 3 and/or along the depth P of the shading device 3.

Therefore, the design of the electrical power supply device 31 allows recharging the battery 24 from the external electrical energy supply source 25 in a simple and convenient manner for the user.

Furthermore, the design of the electrical power supply device 31 avoids the need for a user to climb a step ladder to access the second electrical connection element 38 disposed at the holding device 9, 23 of the screen 2.

Moreover, the design of the electrical power supply device 31 improves the aesthetics of the shading device 3, since the second electrical connection element 38 can be integrated at the holding device 9, 23 of the screen 2 and daylight, that is to say a gap through which light can pass, can be minimised between the screen 2 and the holding device 9, 23 of the screen 2.

The resilient element 39 thus allows the first electrical connection element 37 to connect to the second electrical connection element 38, when the screen 2 reaches the position for recharging the battery 24, in other words before the load bar 8 reaches the holding device 9, 23 of the screen 2, in particular a lower edge of the housing 9, during an upward movement of the screen 2.

Furthermore, the resilient element 39 is configured to deform, in other words deforms, when the first electrical connection element 37 is brought into contact with the second electrical connection element 38, when the screen 2 reaches the position for recharging the battery 24.

Moreover, the resilient element 39 is configured to deform, in other words deforms, in the event of a collision between the first electrical connection element 37 and a part of the shading device 3, in particular the holding device 9, 23 of the screen 2, when the screen 2 is moved to the position for recharging the battery 24, so as to avoid damage to the shading device 3, in particular in the event that the electromechanical actuator 11 moves the screen 2 beyond the position for recharging the battery 24, during an upward movement of the screen 2.

The resilient element 39 is also configured to deform, in other words deforms, when storing and transporting the shading device 3 and, more particularly, the electrical power supply device 31.

Furthermore, an assembly of the resilient element 39 supporting the first electrical connection element 37 on the load bar 8 facilitates an electrical connection between the external electrical energy supply source 25 and the first electrical connection element 37, since this electrical connection can be established when the screen 2 is in a lowered position or in a lowered end-of-travel position, in other words without the need to climb on a step ladder to access the first electrical connection element 37.

Moreover, the battery 24 can be recharged without having to dismantle part of the shading device 3 and, in particular, of the holding device 9, 23 of the screen 2, especially the housing 9 of the shading device 3.

Here, as the shading device 3 is a roller blind, the resilient element 39 makes it possible to take into account an offset between the first electrical connection element 37 and the second electrical connection element 38 due to a variation of the winding thickness of the screen 2 around the winding tube 4, in particular according to the depth P of the shading device 3.

This offset is, especially, due to a thickness of the fabric that forms the screen 2, a number of turns of the screen 2 around the winding tube 4 and a diameter of the winding tube 4.

Advantageously, the electrical connection between the first electrical connection element 37 and the second electrical connection element 38 is established following a movement of the screen 2, in particular raising the screen 2, to the position for recharging the battery 24.

Advantageously, the position for recharging the battery 24 can be determined during the installation of the shading device 3 and, in particular, when learning the upper and lower end-of-travel positions of the screen 2.

In one embodiment, it may be determined that the position for recharging the battery 24 has been reached by means of a counting device, in particular the number of revolutions of the output shaft 20 of the electromechanical actuator 11, the number of revolutions of the rotor of the electric motor 16 or the operating time of the electromechanical actuator 11.

In variant, it may be determined that the position for recharging the battery 24 has been reached by means of the end-of-travel and/or obstacle detection device of the electromechanical actuator 11.

Advantageously, the electrical power supply device 31 comprises at least one power supply cable 30. Furthermore, the first electrical connection element 37 is electrically connected to the external electrical energy supply source 25 via the power supply cable 30.

Thus, the power supply cable 30 that electrically connects the external electrical energy supply source 25 to the first electrical connection element 37 is driven by the movement of the screen 2, by means of the electromechanical actuator 11, to the position for recharging the battery 24.

Advantageously, the resilient element 39 comprises at least one portion 39*a* that forms a spring.

Here as shown in FIGS. 4 and 5, the portion 39*a* that forms the spring is a spiral.

Advantageously, at least a portion of the power supply cable 30 is disposed within the portion 39*a* that forms the spring.

In practice, the portion 39*a* that forms the spring is a compression spring.

Advantageously, the portion 39*a* that forms the spring is made of metal.

In variant, the portion 39*a* that forms the spring is made of plastic material.

In practice, the first electrical connection element 37 comprises an electrical connector, not shown. The second electrical connection element 38 comprises an electrical connector, not shown. Furthermore, the electrical connector of the first electrical connection element 37 is configured to cooperate, in other words cooperates, with the electrical connector of the second electrical connection element 38.

Advantageously, the first and second electrical connection elements 37, 38 comprise electrical contact elements, not shown, so as to establish electrical conduction between the first and second electrical connection elements 37, 38, when the screen 2 is in the position for recharging the battery 24.

Thus, the electrical connection between the first electrical connection element 37 and the second electrical connection element 38 is only established when the first electrical connection element 37 is brought into contact with the second electrical connection element 38, in other words only when the screen 2 is in the position for recharging the battery 24.

The electrical conduction between the first and second electrical connection elements is interrupted as soon as the screen 2 is in a position other than the position for recharging the battery 24.

Here, the position for recharging the battery 24 is defined by the electrical contact elements of the first electrical connection element 37 coming into contact with the electrical contact elements of the second electrical connection element 38.

Advantageously, it is determined that the position for recharging the battery 24 has been reached when the electrical contact elements of the first electrical connection element 37 are brought into contact with the electrical contact elements of the second electrical connection element 38, so as to send a signal to the electronic control unit 15.

Thus, after this signal has been received by the electronic control unit 15, it transmits a command order to stop the electromechanical actuator 11.

In this way, the movement of the first electrical connection element 37 with respect to the second electrical connection element 38 is controlled by the electronic control unit 15 and, more particularly, by the movement of the screen 2 through the electromechanical actuator 11.

Advantageously, the first electrical connection element 37 comprises two electrical contact elements. Furthermore, the second electrical connection element 38 comprises two electrical contact elements.

The electrical contact elements of the first electrical connection element 37 cooperate, in other words are configured to cooperate, with the electrical contact elements of the second electrical connection element 38, when the screen 2 is in the position for recharging the battery 24.

Here, the electrical contact elements of the first and second electrical connection elements 37, 38 are electrical connection surfaces that cooperate with one another.

Here, the electrical contact elements of the first electrical connection element 37 are disposed at an upper wall of the first electrical connection element 37 and the electrical contact elements of the second electrical connection element 38 are disposed at a lower wall of the second electrical connection element 38, in the assembled configuration of the shading device 3.

In practice, the electrical contact elements of the second electrical connection element 38 are electrically connected to the battery 24 by means of electrical supply wires, not shown.

Advantageously, the first electrical connection element 37 comprises a first magnetic portion 40. The second electrical connection element 38 comprises a second magnetic portion 41. Furthermore, the first magnetic portion 40 cooperates, in other words is configured to cooperate, with the second magnetic portion 41, so as to hold the first electrical connection element 37 against the second electrical connection element 38, when the screen 2 is in the position for recharging the battery 24.

Thus, the first and second magnetic portions 40, 41 of the first and second electrical connection elements 37, 38 ensure, on the one hand, the positioning of the first electrical connection element 37 opposite the second electrical connection element 38 and, on the other hand, ensure the electrical connection of the first electrical connection element 37 with the second electrical connection element 38, when the screen 2 reaches the position for recharging the battery 24.

In practice, the first magnetic portion 40 of the first electrical connection element 37 and the second magnetic portion 41 of the second electrical connection element 38, respectively, comprise at least one permanent magnet.

Here, the second electrical connection element 38 is provided in one of the side panels 10 of the housing 9. Furthermore, the portion of the side panel 10 of the housing 9 that comprises the second electrical connection element 38 is accessible from outside the holding device 9, 23 of the screen 2, in particular without having to dismantle one or more elements of the shading device 3, such as, for example, a part of the housing 9.

Thus, the design of the electrical power supply device 31 allows simple access to the second electrical connection element 38, in particular without the user having to dismantle and reassemble the shading device 3.

Advantageously, the first electrical connection element 37 comprises a first centring element 43. The second electrical connection element 38 comprises a second centring element 44. Furthermore, the first centring element 43 cooperates, in other words is configured to cooperate, with the second centring element 44, so as to centre the first electrical connection element 37 with respect to the second electrical connection element 38, when the screen 2 is in the position for recharging the battery 24, as illustrated in FIG. 5.

Thus, the first electrical connection element 37 is positioned relative to the second electrical connection element 38 by the cooperation of the first centring element 43 of the first electrical connection element 37 with the second centring element 44 of the second electrical connection element 38.

In this way, this positioning of the first electrical connection element 37 with respect to the second electrical connection element 38 ensures electrical contact between the electrical contact elements of the first electrical connection element 37 and the electrical contact elements of the second electrical connection element 38, when the screen 2 is in the position for recharging the battery 24.

Advantageously, the first centring element 43 is a pin. Furthermore, the second centring element 44 is a hole, or vice versa.

Advantageously, the electrical power supply device 31 comprises at least one fastening element 42. Furthermore, the fastening element 42 fastens, in other words is configured to fasten, the resilient element 39 to the load bar 8.

Advantageously, the load bar 8 comprises a first end 8*a* and a second end 8*b*. The second end 8*b* is opposite the first end 8*a*.

Here, the fastening element 42 is a resilient snap-in fastening element. Furthermore, the fastening element 42 is configured to cooperate, in other words cooperates, with an outer contour 8*c* of the load bar 8.

Thus, the fastening element 42 is configured to be assembled, in other words is assembled, on the load bar 8 without removing a closure element, not shown, from one of the ends 8*a*, 8*b* of the load bar 8.

Advantageously, the fastening element 42 comprises a notch 45. The notch 45 is configured to receive, in other words receives, a portion of the power supply cable 30, so as to hold the power supply cable 30 in position relative to the load bar 8, in particular by a resilient snap-fastening.

Advantageously, the resilient element 39, the first electrical connection element 37, the power supply cable 30 and, eventually, the fastening element 42 form part of the external electrical energy supply source 25.

Thus, the resilient element 39, the first electrical connection element 37 and, eventually, the fastening element 42 are configured so as to be temporarily assembled, in other words are temporarily assembled, on the load bar 8, in particular when the battery 24 is being recharged by the external electrical energy supply source 25.

In this way, designing an assembly so as to comprise the external electrical energy supply source 25, the resilient element 39, the first electrical connection element 37, the power supply cable 30 and, eventually, the fastening element 42 avoids the loss of an element necessary for recharging the battery 24 by the external electrical energy supply source 25.

In such a case, the first electrical connection element 37 is electrically connected to the external electrical energy supply source 25 via the power supply cable 30, which passes through the resilient element 39, without the need for additional electrical connection elements. In other words, the first electrical connection element 37 is electrically connected directly to the external electrical energy supply source 25.

Advantageously, the second electrical connection element 38 is either integrated into the holding device 9, 23 of the screen 2 and, more particularly, into the side panel 10 of the housing 9, or is mounted on the holding device 9, 23 of the screen 2 and, more particularly, on the side panel 10 of the housing 9 via at least one fastening element, not shown.

In the second case, the fastening element of the second electrical connection element 38 on the holding device 9, 23 of the screen 2 and, more particularly, on the side panel 10 of the housing 9 is advantageously a resilient snap-in fastening element or a screwing fastening element.

Figure 6:
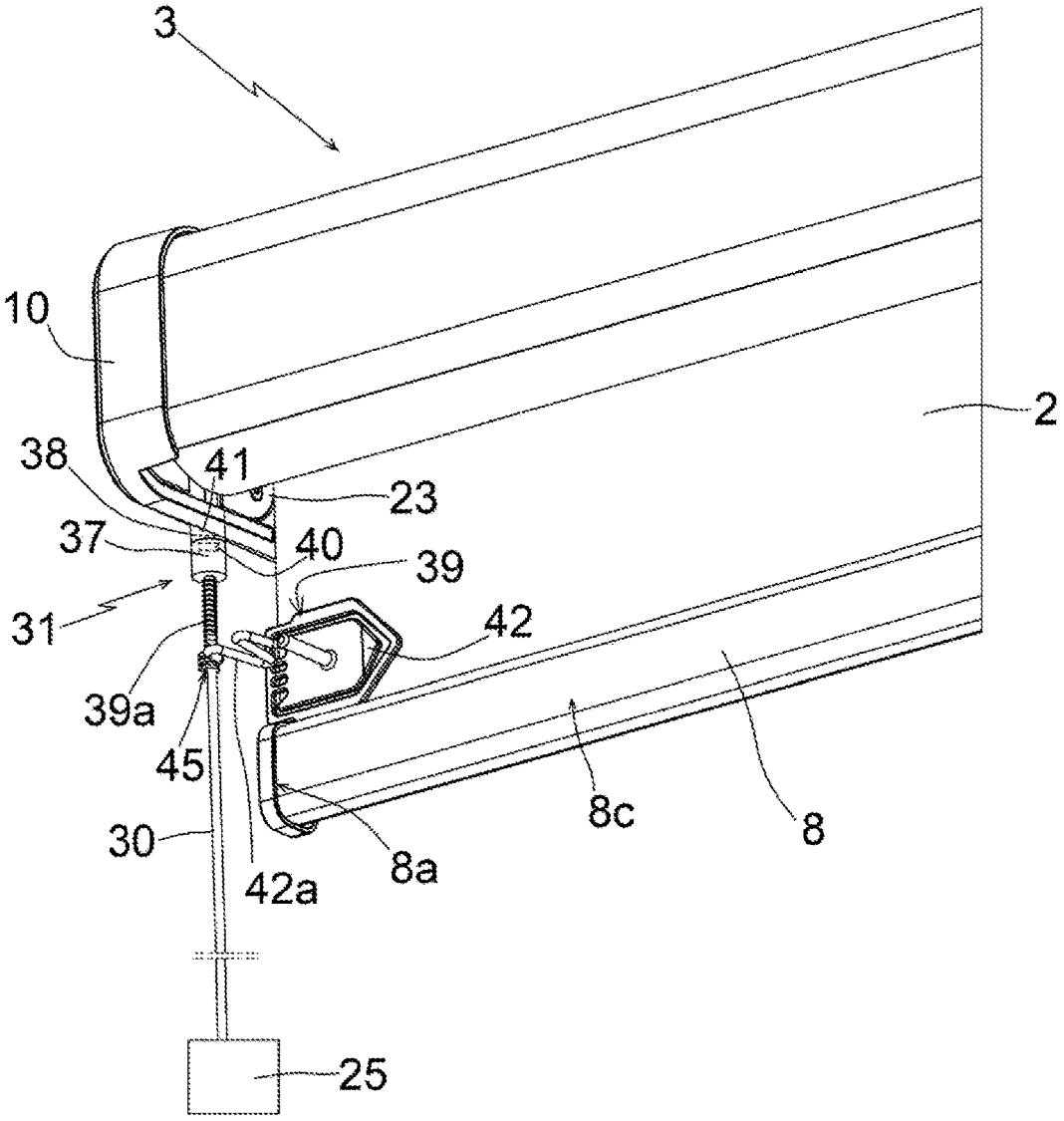
FIG. 6 is a partial and perspective schematic view of a shading device according to a second embodiment of the invention.
Figure 7:
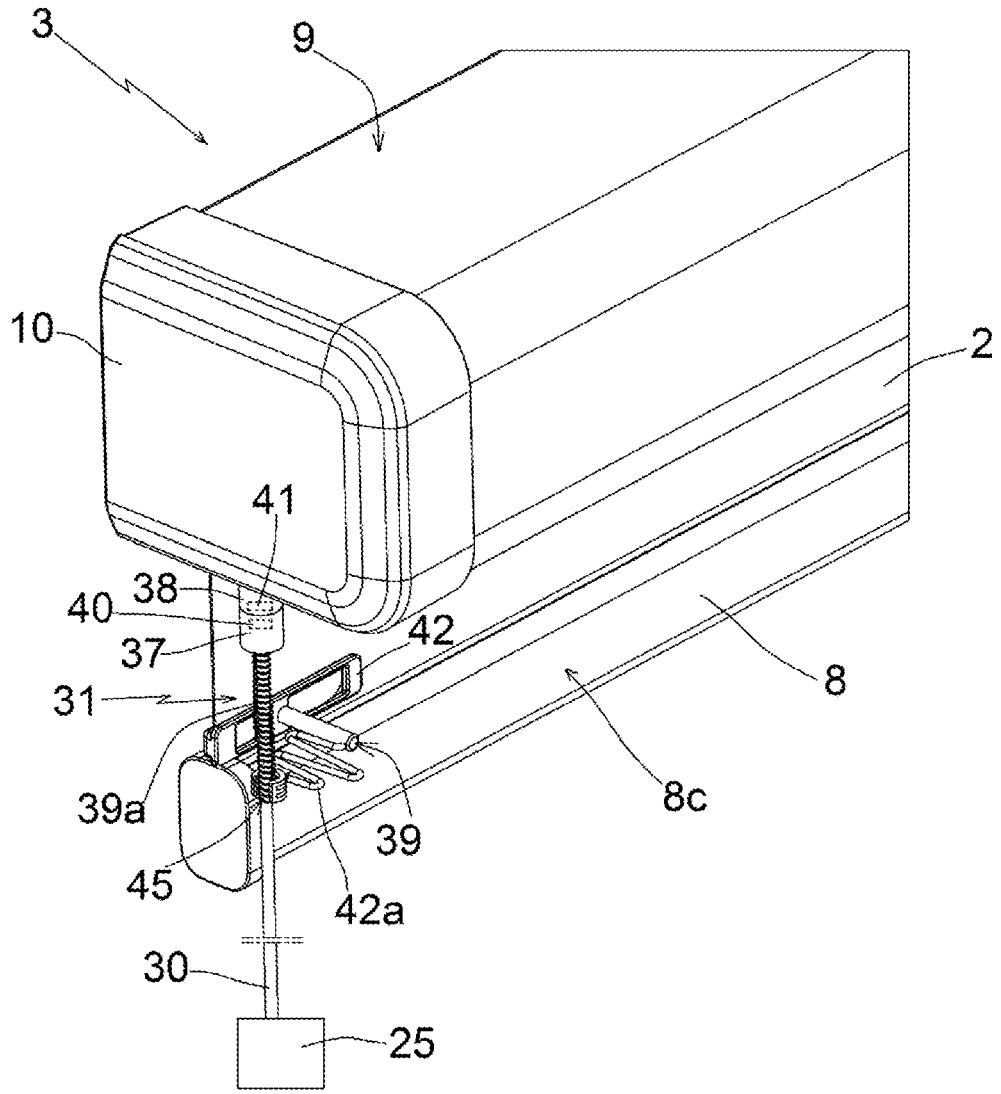
FIG. 7 is a partial and perspective schematic view of a shading device according to a third embodiment of the invention.

In the second and third embodiments, shown in FIG. 6 and FIG. 7 respectively, the elements similar to those of the first embodiment have the same references and function as explained above. In the following, it is mainly described what distinguishes these second and third embodiments from the previous one. In the following, when a reference sign is used without being reproduced in FIG. 6 or FIG. 7, it corresponds to the object bearing the same reference in any of FIGS. 1 to 5.

With reference to FIG. 6 and FIG. 7, the shading device 3 and, more particularly, the electrical power supply device 31 according to the second and third embodiments of the invention are now described.

Here, the first electrical connection element 37 is disposed at the screen 2 of the shading device 3. "At the screen" will be understood to mean that the first electrical connection element 37 is integral with the screen 2.

Advantageously, the resilient element 39 is configured to be fixed on the screen 2. The fastening element 42 fastens, in other words is configured to fasten, the resilient element 39 to the screen 2.

Here, the fastening element 42 is a clamp. Furthermore, the fastening element 42 is configured to be clamped onto the screen 2.

Thus, an assembly of the resilient element 39 supporting the first electrical connection element 37 on the screen 2, in particular on a lower part of the screen 2, facilitates an electrical connection of the external electrical energy supply source 25 to the first electrical connection element 37, since this assembly can be implemented when the screen 2 is in a lowered position or in a lowered end-of-travel position, in other words without having to climb on a step ladder to access the first electrical connection element 37.

Here, the notch 45 of the fastening element 42 is configured to receive, in other words receives, a part of the power supply cable 30, so as to hold the power supply cable 30 in position relative to the screen 2, in particular by a resilient snap-in fastening.

Advantageously, the fastening element 42 comprises at least one portion 42*a* that forms a spring.

Thus, when the screen 2 reaches the position for recharging the battery 24, the portion 42*a* of the fastening element 42 also makes it possible to compensate a misalignment of the first electrical connection element 37 with respect to the second electrical connection element 38, in particular along the width L of the shading device 3, or along the depth P of the shading device 3, or along the width L of the shading device 3 and the depth P of the shading device 3, in addition to the resilient element 39.

Here and as illustrated in FIGS. 6 and 7, the portion 42*a* that forms the spring is formed in a zig-zag pattern.

In practice, the portion 42*a* that forms the spring is a compression spring.

Advantageously, the portion 42*a* that forms the spring is made of plastic material.

In variant, the portion 42*a* that forms the spring is made of metal.

The difference between the second and third embodiments results from the geometry of the clamp forming the fastening element 42. In the embodiment of FIG. 6, said clamp has a pentagonal base. In the embodiment of FIG. 7, said clamp has a rectangular base.

An embodiment of a method for recharging the battery 24 for the shading device 3 according to the invention is now described, said method being applicable regardless of the embodiment, illustrated in FIGS. 1 to 7.

The method for recharging the battery 24 comprises at least the following steps, preferably performed in the order mentioned:

lowering the screen 2 towards the lower end-of-travel position, assembling the fastening element 42 on the load bar 8 or on the screen 2, fastening the resilient element 39 to the fastening element 42, raising the screen 2 to the position for recharging the battery 24, establishing an electrical connection between the first and second electrical connection elements 37, 38, and recharging the battery 24 using electrical energy from the external electrical energy supply source 25.

Advantageously, the steps of lowering and raising the screen 2 are implemented by the motorised drive device 5 and, more particularly, by the electromechanical actuator 11.

Advantageously, the method also comprises a first step of transmitting a signal or a message from the electronic control unit 15 to one of the local control units 12 or central control unit 13 relating to a charging status of the battery 24 below a predetermined threshold value, and then a second step of transmitting a command order from the local control unit 12 or central control unit 13 to lower the screen 2 in the direction of the lower end-of-travel position.

In practice, the first and second transmission steps are implemented prior to the step of lowering the screen 2.

Advantageously, the method further comprises a step of electrically connecting the external electrical energy supply source 25 to the mains power supply.

In practice, the connection step is implemented following the step of fastening the resilient element 39 and prior to the step of raising the screen 2.

Advantageously, the method further comprises a third step of transmitting from the local control unit 12 or central control unit 13 a command order to raise the screen 2 towards the position for recharging the battery 24.

In practice, the third transmission step is implemented following the step of electrically connecting the external electrical energy supply source 25 and prior to the step of raising the screen 2.

Advantageously, the method further comprises a first step of signalling that the battery 24 is being recharged by the external electrical energy supply source 25.

In practice, the first signalling step is implemented following the electrical connection step.

In practice, the first signalling step is implemented by a movement of the screen 2 controlled by the motorised drive device 5 and/or by an activation of a light source of the local control unit 12 or central control unit 13.

Advantageously, the movement of the screen 2 corresponds to a back-and-forth movement of the screen 2, in particular over a short distance which may be, for example, in the order of one centimetre.

Advantageously, the light source can be switched on according to a predetermined flashing pattern and/or with a specific colour, for example orange.

Advantageously, the method further comprises a second step of signalling that the battery 24 has finished being recharged by the external electrical energy supply source 25.

In practice, the second signalling step is implemented following the electrical energy recharging step.

In practice, the second signalling step is implemented by operating another light source of the local control unit 12 or central control unit 13, or the same light source of the local control unit 12 or central control unit 13.

Advantageously, the light source can be operated in a continuous lighting state and/or with another specific colour, for example green.

Advantageously, the method further comprises a third step of signalling an electrical connection fault between the battery 24 and the external electrical energy supply source 25 and, more particularly, an electrical connection fault between the first and second electrical connection elements 37, 38 and/or an electrical connection fault between the external electrical energy supply source 25 and the mains power supply.

Thanks to the present invention, regardless of the embodiment, when the screen reaches the position for recharging the battery, the resilient element allows the first electrical connection element to be aligned with the second electrical connection element, in particular along a width of the shading device, or along a depth of the shading device, or along the width of the shading device and the depth of the shading device.

Numerous modifications can be made to the embodiments described above, without departing from the scope of the invention as defined by the claims.

In variant, not shown, the electrical power supply device 31 comprises a third electrical connection element. The third electrical connection element is integral with the resilient element 39. Furthermore, the third electrical connection element is configured to be electrically connected, in other words is electrically connected, on the one hand, to the first electrical connection element 37 and, on the other hand, to the external electrical energy supply source 25. Thus, the first electrical connection element 37 is electrically connected to the external electrical energy supply source 25 via the third electrical connection element and, eventually, to the power supply cable 30. Advantageously, the resilient element 39 further comprises a power supply cord. In this case, the power supply cable is not disposed inside the resilient element 39 and the connection between the first electrical connection element 37 and the external electrical energy supply source 25 is also established through this power supply cord. Furthermore, the power supply cord is configured so as to be electrically connected, in other words electrically connects, the third electrical connection element to the first electrical connection element 37.

In variant, not shown, the second electrical connection element 38 is provided in the torque support 21 or in one of the supports 23. Furthermore, the part of the torque support 21 or the support 23 comprising the second electrical connection element 38 is accessible from outside the holding device 9, 23 of the screen 2, in particular without having to dismantle one or more elements of the shading device 3, such as, for example, a part of the housing 9, in particular a side panel 10. Thus, the design of the electrical power supply device 31 allows simple access to the second electrical connection element 38, in particular without operations on the part of the user to dismantle and reassemble the shading device 3. Advantageously, the second electrical connection element 38 is accessible through one of the side panels 10 of the housing 9, by means of an undercut in same, since the torque support 21 or the support 23 is disposed inside said side panel 10.

In variant, not shown, the fastening element 42 is a socket element. The load bar 8 comprises an opening at least at one of the first and second ends 8*a*, 8*b* thereof. Furthermore, the fastening element 42 is fitted into place within the opening of the load bar 8. Thus, the fastening element 42 is formed as a plug that closes the opening of the first or second end 8*a*, 8*b* of the load bar 8.

In variant, not shown, the fastening element 42 may be replaced by one or more magnets or one or more fixing screws. In the case where the fastening element 42 is non-removably connected to the load bar 8, the fastening element 42 may be replaced by one or more rivets.

In variant, not shown, the resilient element of the electrical power supply device 31 may be formed by the portion 42*a* of the fastening element 42. In this case, the electrical power supply device 31 is without the resilient element 39 shown in FIGS. 4 to 7. Thus, the resilient element, constituted by the portion 42*a* of the fastening element 42, is an integral part of the fastening element 42, in other words the resilient element and the fastening element of the electrical power supply device 31 form a single piece, such as the fastening elements 42 shown in FIGS. 6 and 7. Moreover, the first electrical connection element 37 is integral with the portion 42*a* of the fastening element 42, that is to say assembled or fixed on the portion 42*a* of the fastening element 42, integrated with the portion 42*a* of the fastening element 42 or held by the portion 42*a* of the fastening element 42, especially in the case where the first electrical connection element 37 is disposed at one end of the power supply cable 30.

In variant, not shown, the portion 39*a* of the resilient element 39 is an extension element of the power supply cable 30, instead of a portion of the power supply cable 30 being disposed within the portion 39*a* of the resilient element 39. In this case, the portion 39*a* of the resilient element 39 is an integral part of the power supply cable 30 and allows electrical energy to be supplied to the battery 24 from the external electrical energy supply source 25.

In variant, not shown, the external electrical energy supply source 25 is an auxiliary battery, provided so as to recharge the battery 24. Thus, the battery 24 can be recharged by means of the auxiliary battery forming the external electrical energy supply source 25, in particular in the case where the shading device 3 is remote from a wall socket. In this case, the auxiliary battery can, advantageously, be removably fixed on the load bar 8, so as to recharge the battery 24 disposed at the holding device 9, 23 of the screen 2. In practice, the elements for fastening the auxiliary battery, forming the external electrical energy supply source 25, on the load bar 8 are elastic snap-in fastening elements. Furthermore, the auxiliary battery which forms the external electrical energy supply source 25 and which is intended to cooperate with the first electric connection element 37 may recharge a battery of other electric equipment, in particular mobile equipment, such as, for example, a mobile telephone or a portable computer. Moreover, such an auxiliary battery forming the external electrical energy supply source 25 may have at least two electrical outputs, in particular a first output delivering a voltage of 12 volts to supply electrical energy to the battery 24 disposed at the holding device 9, 23 of the screen 2 and a second output delivering a voltage of 5 volts to supply electrical energy to other electrical equipment, said to be mobile.

In variant, not shown, the electrical power supply device 31 further comprises at least a photovoltaic panel, forming a further external electrical energy supply source. The battery 24 is supplied with electrical energy, in other words is configured to be supplied with electrical energy, by means of the photovoltaic panel. Eventually, the electromechanical actuator 11 is supplied with electrical energy, in other words is configured to be supplied with electrical energy, directly by means of the photovoltaic panel.

In variant, not shown, the electromechanical actuator 11 is inserted into a rail, in particular having a square or rectangular cross section, which may be open at one or both ends, in the assembled configuration of the shading device 3. Moreover, the electromechanical actuator 11 may be configured to drive a drive shaft on which cords for moving and/or orienting the screen 2 are wound.

Furthermore, the embodiments and variants envisaged may be combined to create novel embodiments of the invention, without departing from the scope of the invention defined by the claims.

The invention claimed is:

1. Shading device, the shading device comprising at least:

a screen, a holding device for holding the screen, a first end of the screen being disposed at the holding device of the screen, a load bar, a second end of the screen being fixed on the load bar, a motorised drive device, and an electrical power supply device, the motorised drive device comprising at least:

an electromechanical actuator, the electromechanical actuator being configured to move the screen, the electrical power supply device comprising at least:

a battery, the battery being disposed at the holding device of the screen, the battery being electrically connected to the electromechanical actuator, a first electrical connection element, the first electrical connection element being disposed at the load bar or the screen, the first electrical connection element being configured to be electrically connected to an external electrical energy supply source, so as to recharge the battery, and a second electrical connection element, the second electrical connection element being disposed at the holding device of the screen, the second electrical connection element being configured to cooperate with the first electrical connection element, only when the screen is in a position for recharging the battery, the position for recharging the battery corresponding either to an upper end-of-travel position of the screen, or to a position of the screen where the load bar is in proximity to the holding device of the screen, so as to establish an electrical connection between the first electrical connection element and the second electrical connection element, wherein the electrical power supply device further comprises a resilient element, the resilient element being configured to be fixed on the load bar or on the screen, the first electrical connection element being integral with the resilient element, and wherein the resilient element is configured to compensate a misalignment of the first electrical connection element with respect to the second electrical connection element, when the screen reaches the position for recharging the battery.

2. Shading device according to claim 1, wherein the resilient element comprises at least one portion that forms a spring.

3. Shading device according to claim 1, wherein:

the first electrical connection element comprises a first magnetic portion, the second electrical connection element comprises a second magnetic portion, and the first magnetic portion cooperates with the second magnetic portion, so as to hold the first electrical connection element against the second electrical connection element, when the screen is in the position for recharging the battery.

4. Shading device according to claim 1, wherein:

the first electrical connection element comprises a first centring element the second electrical connection element comprises a second centring element, and the first centring element cooperates with the second centring element, so as to centre the first electrical connection element with respect to the second electrical connection element, when the screen is in the position for recharging the battery.

5. Shading device according to claim 4, wherein:

in that the first centring element is a pin, and the second centring element is a hole, or vice versa.

6. Shading device according to claim 1, wherein:

the electrical power supply device comprises at least one fastening element, and the fastening element fastens the resilient element to the load bar or to the screen.

7. Shading device according to claim 6, wherein:

the fastening element is a resilient snap-in fastening element, and the fastening element is configured to cooperate with an outer contour of the load bar.

8. Shading device according to claim 6, wherein:

the fastening element is a clamp, and the fastening element is configured to be clamped onto the screen.

9. Shading device according to claim 1, wherein:

the electrical power supply device comprises a third electrical connection element, the third electrical connection element is integral with the resilient element, and the third electrical connection element is configured to be electrically connected, on the one hand, to the first electrical connection element and, on the other hand, to the external electrical energy supply source.

10. Shading device according to claim 1, wherein:

the shading device further comprises a winding tube, the screen can be rolled up onto the winding tube, and the winding tube is arranged so as to be rotated by the electromechanical actuator.

* * * * *